United States Patent [19]

Kennedy

[11] Patent Number: 5,061,163

[45] Date of Patent: Oct. 29, 1991

[54] DIE ASSEMBLY

[75] Inventor: Stephen T. Kennedy, Preston, United Kingdom

[73] Assignee: United Kingdom Atomic Energy Authority, London, England

[21] Appl. No.: 598,745

[22] Filed: Oct. 15, 1990

Related U.S. Application Data

[63] Continuation of Ser. No. 374,972, Jul. 3, 1989, abandoned.

[30] Foreign Application Priority Data

Jul. 19, 1988 [GB] United Kingdom ..... 8817163
Oct. 10, 1988 [GB] United Kingdom ..... 8823700

[51] Int. Cl.[5] ..... B21C 25/04

[52] U.S. Cl. ..... 425/79; 72/264; 72/269; 425/461; 425/467

[58] Field of Search ..... 425/192 R, 461, 464, 425/467, 79, 462; 72/264, 269, 468, 60, 262

[56] References Cited

U.S. PATENT DOCUMENTS

| | | | |
|---|---|---|---|
| 715,358 | 12/1902 | Dick | 72/269 |
| 2,135,194 | 11/1938 | Underhill | 72/468 |
| 2,164,750 | 7/1939 | Nadler | 425/461 |
| 2,276,468 | 3/1942 | Couchman | 72/269 |
| 2,368,355 | 1/1945 | Guiney | 72/468 |
| 2,638,213 | 5/1953 | Clark | 72/269 |
| 2,673,645 | 3/1954 | Moczik | 72/468 |
| 3,349,434 | 10/1967 | Hureau | 425/464 |
| 3,471,899 | 10/1969 | Ronden | 425/192 R |
| 3,748,885 | 7/1973 | Creuzet | 72/468 |
| 3,777,544 | 12/1973 | Alexandrov et al. | 72/269 |
| 3,858,426 | 1/1975 | Kuske et al. | 72/468 |
| 4,045,154 | 8/1977 | Ratheiser | 425/467 |
| 4,362,485 | 12/1982 | Slater et al. | 425/224 |
| 4,365,949 | 12/1982 | Nash | 425/467 |
| 4,470,793 | 9/1984 | Cavalli | 425/467 |
| 4,509,907 | 4/1985 | Ratheiser | 425/467 |
| 4,516,926 | 5/1985 | Yip | 425/464 |
| 4,598,567 | 7/1986 | Backus | 72/269 |
| 4,818,463 | 4/1989 | Buchning | 425/72.2 |

FOREIGN PATENT DOCUMENTS

| | | | |
|---|---|---|---|
| 14249 | 10/1955 | Fed. Rep. of Germany | 72/269 |
| 56-165512 | 12/1981 | Japan | 72/269 |
| 59-118419 | 7/1984 | Japan | 425/461 |
| 275983 | 7/1970 | U.S.S.R. | 72/269 |

*Primary Examiner*—Jay H. Woo
*Assistant Examiner*—James P. Mackey
*Attorney, Agent, or Firm*—William R. Hinds

[57] ABSTRACT

A die assembly for use in a continuous extrusion apparatus is made up of two cooperating members. The first member has tapered apertures therethrough disposed symmetrically about a mandrel portion. The mandrel portion cooperates with a throat portion in the second member to define an extrusion gap. A ceramic insert can be located in the second member to reduce wear during the extrusion of materials such as copper.

3 Claims, 3 Drawing Sheets

DIE ASSEMBLY

This is a continuation of application Ser. No. 374,972 filed July 3, 1989, now abandoned.

The present invention concerns a die assembly and in particular a die assembly for use in the continuous extrusion of materials.

It is the aim of the present invention to provide a die assembly which is capable of withstanding the heavy stresses imposed thereon during extrusion and in particular during extrusion of materials such as copper and other metals.

FEATURES AND ASPECTS OF THE INVENTION

According to the present invention a die assembly for the extrusion of metal tube includes first and second members, the first member having only two identical tapered apertures, the two apertures being disposed symmetrically about the longitudinal axis of the first member, the apertures extending through the first member and having generally circular entrance openings which are immediately contiguous so as to contact each other only in the immediate vicinity of said longitudinal axis at one face of the first member, an integral mandrel extending axially from the opposite face of the first member, and the second member having a through passage defining an enlarged chamber portion reducing to a throat portion, the first and second members cooperating to define an annular extrusion chamber formed by the enlarged chamber portion and the mandrel, the mandrel cooperating with the throat portion of the second member to define an annular extrusion gap therebetween and the tapered apertures in the first member leading into the extrusion chamber.

The invention will be described further, by way of example, with reference to the accompanying drawings; in which:

DESCRIPTION OF THE PREFERRED EMBODIMENTS

Figure 1:
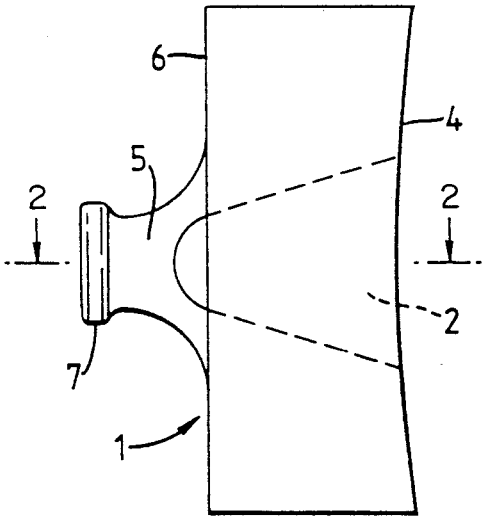
FIG. 1 depicts a first member of a die assembly
Figure 2:
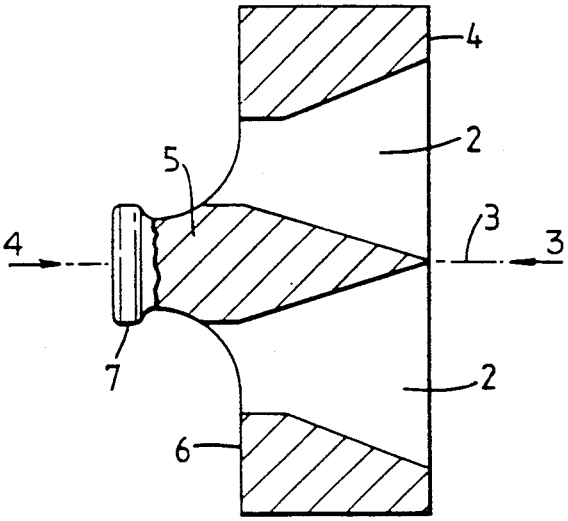
FIG. 2 is a section on 2—2 in FIG. 1.

With reference to FIGS. 1 to 4, a first member of a die assembly comprises a body 1 having tapered apertures 2 therethrough disposed symmetrically about the axis 3 of the body. The apertures 2 are contiguous on the axis at the face 4 of the body. An integral mandrel 5 projects axially from opposite face 6 of the body, the mandrel 5 terminating in a boss 7.

Figure 3:
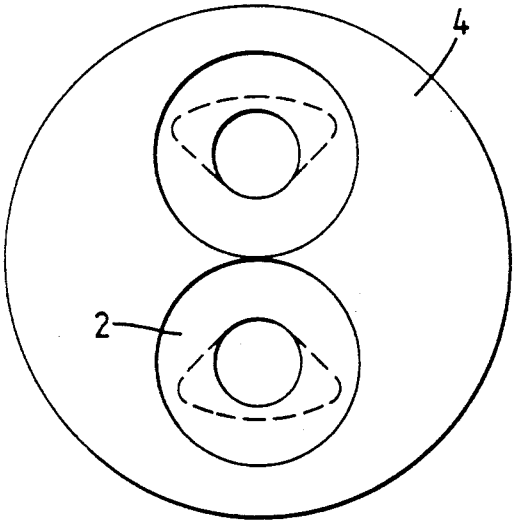
FIG. 3 is a view in direction 3 in FIG. 2.
Figure 4:
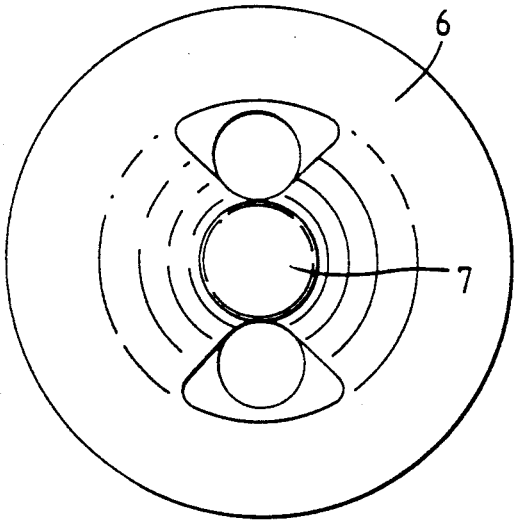
FIG. 4 is a view in direction 4 in FIG. 2.

In moving from the face 4 towards the face 6, the apertures 2 are substantially frusto-conical and reducing circular cross-section. Conveniently, the apertures can include an angle of 30°. Over a final short length to the face 6 the apertures change from a circular cross-section to a substantially kidney-shaped section as seen in FIGS. 3 and 4.

Figure 5:
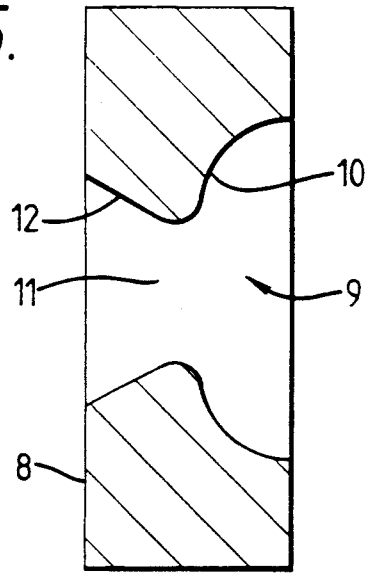
FIG. 5 is a section through a second member of the die assembly.

The second member of the die assembly shown in section in FIG. 5 comprises a body 8 having a through passage 9. The passage 9 defines an enlarged chamber portion 10 which reduces to a throat 11 followed by a frusto-conical portion 12.

Figure 6:
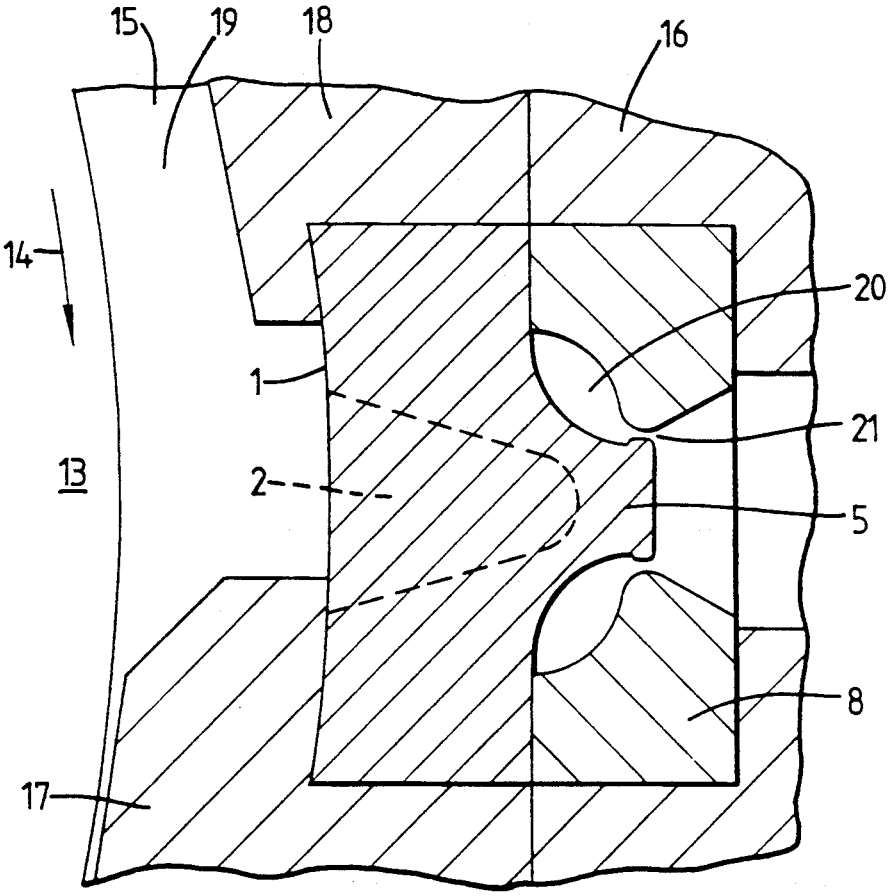
FIG. 6 depicts the die assembly in a continuous extrusion apparatus.

FIG. 6 shows the die assembly incorporated in a continuous extrusion apparatus of the kind such as disclosed in UK Patent Specifications 1,370,894 and 1,434,201 (U.S. Patent Specifications 3,765,216 and 3,872,703 respectively). Briefly, the apparatus comprises a wheel 13 secured to a horizontal driven shaft (not shown) to rotate in the direction of arrow 14. An endless peripheral groove 15 is formed in the wheel 13 and a stationary shoe member 16 overlies a part of the groove 15.

The shoe member 16 forms a support for the die assembly, an abutment 17 which projects into and blocks the groove and an insert 18 which projects into the groove 15 to define a passageway 19 for receiving feed material.

In use, material fed into the passageway 19 is drawn by frictional drag towards the abutment 17. The abutment 17 serves to block the passageway 19 and cause upsetting of the feed material and extrusion through the die assembly. The material flow is split into two streams defined by the apertures 2 in the first member of the die assembly. The two streams flow into and combine in an annular extrusion chamber 20 formed by the two members of the die assembly and defined by the enlarged chamber portion 10 of the second member and the mandrel 5 of the first member of the die assembly. The mandrel 5 cooperates with the throat 11 of the second member to define an annular gap 21 through which material from the chamber 20 is extruded in the form of tube.

Figure 7:
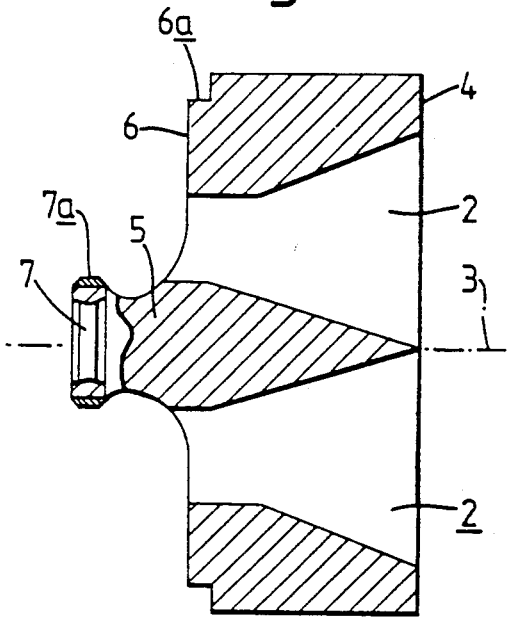
FIG. 7 is section through a modified form of first member and corresponds to FIG. 2.

In the modification of FIG. 7, the face 6 of the first member is relieved to form a spigot 6*a*. The mandrel 5 terminates in a boss 7 having a hardfaced periphery 7*a* such as stellite.

Figure 8:
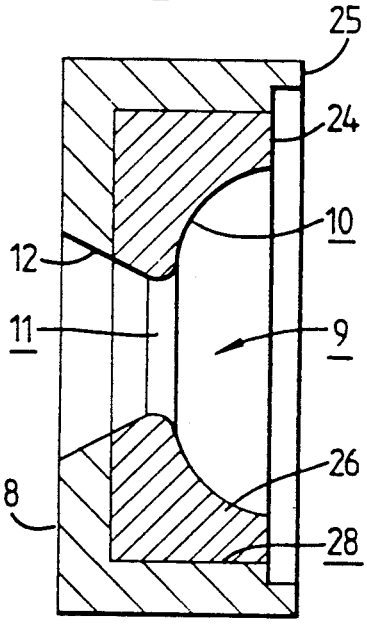
FIG. 8 is a section through a modified form of second member.

In the modified second member shown in section in FIG. 8 the through passage 9 extends from an entry face 24 which defines a rim 25 to mate with the spigot 6*a* in FIG. 7. In order to reduce wear on the walls of the passage 9, a ceramic insert 26 locates in a cylindrical recess 28 in the body 8. The insert 26 can, for example, comprise SYALON (R.T.M.) ceramic or PSZ (partially stabilized zirconia).

Figure 9:
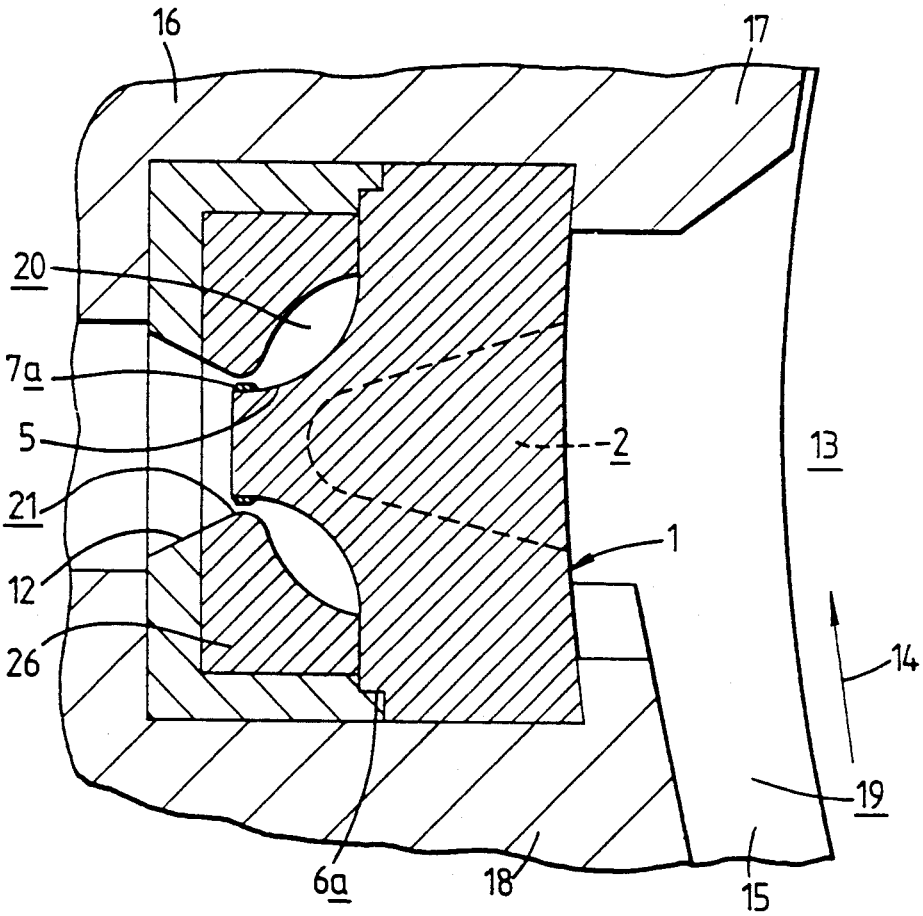
FIG. 9 shows the modified members forming a die assembly in a continuous extrusion apparatus.

FIG. 9 shows the first and second members of FIGS. 7 and 8 respectively assembled in a continuous extrusion apparatus. In FIGS. 7, 8 and 9 the same reference numerals are used as in FIGS. 1 to 6 to denote common component parts.

The material extruded can be copper, a material which hitherto has proved difficult to extrude on a continuous basis. The die assembly can withstand the stresses imposed thereon during the continuous extrusion of copper. The members of the die assembly can be formed from high strength alloys such as those known under the proprietary trade names "Inconel 718" and "Nimonic 105".

Alternative ceramic materials can be used for the insert 26 and although stellite is preferred for the hardfaces periphery 7*a* other wear resistant materials can be used.

Although described in relation to the extrusion of tubing, the die assembly can be adapted to extrude other shapes and profiles such as rod or wire. The inclusion of the ceramic insert resists wear and is especially useful when extruding hard materials.

I claim:

1. A die assembly for the extrusion of metal tube including first and second members, the first member having only two identical tapered apertures, the two apertures, being disposed symmetrically about the longitudinal axis of the first member, the apertures extending through the first member and having generally circular entrance openings which are immediately contiguous so as to contact each other only in the immediate vicinity of said longitudinal axis at one face of the first member, an integral mandrel extending axially from the opposite face of the first member and the second member having a through passage defining an enlarged chamber portion reducing to a throat portion, the first and second members cooperating to define an annular extrusion chamber formed by the enlarged chamber portion and the mandrel, the mandrel cooperating with the throat portion of the second member to define an annular extrusion gap therebetween and the tapered apertures in the first member leading into the extrusion chamber.

2. A die assembly as claimed in claim 1 wherein each of said apertures, in progressing from said one face toward said opposite face, is substantially frusto-conical and of reducing circular across section over an initial substantial part of the aperture length, but, over a final shorter aperture length to said opposite face, changes from a relatively reduce circular cross section to a substantially kidney-shaped cross section which is enlarged relative to said reduced circular cross section.

3. A die assembly as claimed in claim 2 wherein said frusto-conical part of each apertures has an included angle of about 30°.

* * * * *